US007358436B2

(12) United States Patent
Dellagala et al.

(10) Patent No.: US 7,358,436 B2
(45) Date of Patent: Apr. 15, 2008

(54) DUAL-INSULATED, FIXED TOGETHER PAIR OF CONDUCTORS

(75) Inventors: Joseph Dellagala, Shrewsbury, MA (US); Gavriel Vexler, Westmount (CA)

(73) Assignee: Belden Technologies, Inc., St. Louis, MO (US)

( * ) Notice: Subject to any disclaimer, the term of this patent is extended or adjusted under 35 U.S.C. 154(b) by 0 days.

(21) Appl. No.: 11/189,568

(22) Filed: Jul. 26, 2005

(65) Prior Publication Data

US 2006/0021772 A1 Feb. 2, 2006

Related U.S. Application Data

(60) Provisional application No. 60/591,316, filed on Jul. 27, 2004.

(51) Int. Cl.
*H01B 11/00* (2006.01)

(52) U.S. Cl. ..... 174/27; 174/113 R

(58) Field of Classification Search ..... 174/27, 174/113 R

See application file for complete search history.

(56) References Cited

U.S. PATENT DOCUMENTS

| | | | | |
|---|---|---|---|---|
| 3,013,109 | A * | 12/1961 | Gorman et al. | 174/113 R |
| 3,328,510 | A | 6/1967 | White | |
| 4,034,148 | A | 7/1977 | Lang | |
| 4,487,992 | A | 12/1984 | Tomita | |
| 5,015,800 | A | 5/1991 | Vaupotic et al. | |
| 5,097,099 | A | 3/1992 | Miller | |
| 5,142,100 | A | 8/1992 | Vaupotic | |
| 5,202,946 | A | 4/1993 | Hardin et al. | |
| 5,245,134 | A | 9/1993 | Vana, Jr. et al. | |
| 5,286,924 | A | 2/1994 | Loder et al. | |
| 5,525,757 | A * | 6/1996 | O'Brien | 174/121 A |
| 5,563,377 | A | 10/1996 | Arpin et al. | |
| 5,606,151 | A | 2/1997 | Siekierka et al. | |
| 5,658,406 | A | 8/1997 | Walling et al. | |
| 5,744,757 | A | 4/1998 | Kenny et al. | |
| 5,767,441 | A | 6/1998 | Brorein et al. | |
| 5,821,467 | A | 10/1998 | O'Brien et al. | |
| 5,841,072 | A * | 11/1998 | Gagnon | 174/110 F |
| 5,883,334 | A | 3/1999 | Newmoyer et al. | |
| 6,222,129 | B1 * | 4/2001 | Siekierka et al. | 174/113 R |
| 6,255,594 | B1 * | 7/2001 | Hudson | 174/121 A |
| 6,272,828 | B1 | 8/2001 | Walling et al. | |
| 6,273,977 | B1 | 8/2001 | Harden et al. | |
| 6,403,887 | B1 * | 6/2002 | Kebabjian et al. | 174/110 R |
| 6,789,311 | B2 | 9/2004 | Fidi et al. | |

FOREIGN PATENT DOCUMENTS

| | | | |
|---|---|---|---|
| DE | 2555670 | A | 6/1997 |
| EP | 1296336 | A1 | 8/2002 |
| GB | 361930 | | 11/1931 |
| GB | 486970 | | 6/1938 |
| JP | 5159628 | A | 6/1993 |
| JP | 2000-357417 | * | 12/2000 |
| WO | 9634400 | A1 | 10/1996 |

* cited by examiner

*Primary Examiner*—Chau N. Nguyen
(74) *Attorney, Agent, or Firm*—Lowrie, Lando & Anastasi, LLP

(57) ABSTRACT

A high performance data cable comprises first and second insulated conductors, each disposed in a respective first layer of insulation and a second layer of insulation covering the first and second insulated conductors and maintaining the first and second insulated conductors to one another. The first and second insulated conductors and the second layer of insulation are twisted about a common central axis to form a twisted pair unit.

11 Claims, 6 Drawing Sheets

DUAL-INSULATED, FIXED TOGETHER PAIR OF CONDUCTORS

RELATED APPLICATIONS

This application claims priority under 35 U.S.C. § 119(e) to U.S. Provisional Application Ser. No. 60/591,316, entitled "DUAL-INSULATED, FIXED TOGETHER PAIR OF CONDUCTORS," filed on Jul. 27, 2004, which is herein incorporated by reference in its entirety.

FIELD OF THE INVENTION

The present invention relates to high performance data cables, comprising dual-insulated twisted pair conductors that are fixed together along their length.

BACKGROUND

Twisted pair cables have become the physical media of choice for most local area networks. Twisted pair cables typically comprise a plurality of twisted pairs of insulated conductors surrounded by a cable jacket. The EIA/TIA 568 A Category 5 specifications (and the associated addenda) for these cables specify transmission performance requirements, such as maximum cross-talk, attenuation, etc., for transmission frequencies of up to 100 MHz.

Installed transmission systems, such as networks, may operate only at 10 Mbit/s and not use all the available bandwidth offered by cables meeting the existing specifications. Typically the Ethernet protocol used in many of the installed networks, employed only two pairs of the available four and used half-duplex transmission, i.e. one pair is transmitting while the other is receiving.

Transmission technology operating at 100 Mbit/s has been rapidly expanding in the marketplace. Also, improved cables with transmission characteristics exceeding the EIA/TIA 568 A Category 5 specifications (and the associated addenda) have also been developed. Although cables may be designed to meet current performance requirements, process variation during the manufacture of the cable may degrade cable performance to below the required specification. Furthermore, handling of the cable during installation may also degrade cable performance. For these and other reasons, cable manufacturers have developed cables with improved performance characteristics exceeding the requirements.

Newer data transmission technology has raised data rates above 1 Gigabit/s. This transmission technology and some of the existing 100 Mbit/s transmission technologies, when applied to twisted pair cables, may require the use of all four pairs in a cable in full-duplex operation (bi-directional transmission), and may require the transmission performance of the twisted pair wire cables to exceed the EIA/TIA 568 A Category 5 (and associated addenda) specifications.

For many applications, it may be desirable to minimize the delay skew or the differential in the signal velocity amongst the four pairs in order to enable fast de-scrambling of the four bit signals into a coherent bit sequence at the receiving end. In particular, four pair cables usable for bi-directional transmission may need to be high performance in order to obtain the maximum usable bandwidth. Thus, it may also be desirable to design twisted pair cables with low and uniform near and far end crosstalk, i.e. low coupling of the electromagnetic fields between twisted pairs, since crosstalk degrades cable performance. It also may be desirable to minimize the return loss (due to impedance irregularities) of the cable, since a high return loss may also impair transmission.

There are in the marketplace several cable designs that purport to meet and even exceed the Category 6 specifications. One cable design that may have gigabit capability was developed by Belden Wire & Cable Company and is disclosed in U.S. Pat. No. 5,606,151 to Siekierka et al. Siekierka et al. discloses the joining of the two insulated conductors in a pair by an adhesive or by co-extruding the two insulated conductors with a joining web. In one embodiment of the cable disclosed by Siekierka et al., each conductor is centrally disposed within an insulation. The insulations are integral with each other and are joined along their lengths by a solid integral web. Siekierka et al. discloses improved near end and far end crosstalk performance for this design embodiment of cable. The structures also are disclosed to improve the longitudinal impedance uniformity to less than +/−15 ohm and, as a result, to reduce return loss of the resulting four pair twisted cable. The observed reduction in impedance irregularities is explained by Siekierka et al. by the fact that cyclical and random irregularities that can be imparted in the twisted pair during the twisting process due to differences in twisting tension are eliminated when the conductors are first bonded together. It is also disclosed that the cable resists deformation during handling and installation.

U.S. Pat. No. 5,767,441, Brorein et al., discloses eliminating impedance variations through the pre-twisting of insulated conductors prior to twisting the insulated conductors in double twist machines or by twisting the pairs through a single twist process. The Brorein et al. process and others like it like have unleashed a flood of equipment designed to impart a back-twist to conductors of pairs in high performance cables. Brorein et al. further disclose a flat cable structure including a plurality of twisted pairs of conductors. However, the structure of these flat cable designs may pose additional transmission problems, due to inter-cable crosstalk or alien crosstalk, that is, between pairs of different cables, due to the proximity of pairs with same twist lays separated only by the jacket thickness, that may be difficult to cancel electronically through DSP filtering or other conventional techniques.

U.S. Pat. No. 5,563,377, hereinafter Arpin et al, discloses a plenum cable comprising a jacket of minimal smoke emission material surrounding a cable core comprising a plurality of twisted pair conductors. Each of the conductors of the twisted pair conductors comprises a conductor surrounded by a dual insulation, with an inner insulating layer made from a flame retardant polyolefin and an outer layer surrounding the inner layer formed from fluorinated ethylene propylene (FEP).

Other cables capable of gigabit data rates may include a central member separator to separate the individual twisted pairs from one another to reduce crosstalk, as illustrated in FIG. 1. The use of such a central separator 20 typically means that the twisted pairs 22*a, b* are closer to the cable jacket 24 than they would be without the central separator 20. This affects the level of alien crosstalk when two or more cables are stacked together, since the twisted pairs of adjacent cables may be closer together than they would be without the central separator. While the central separator 20 may substantially reduce crosstalk, it may not eliminate impedance irregularities. Furthermore, the insertion of a central member with the four pairs symmetrically disposed around it may be difficult to achieve and may slow down the manufacturing processes. In addition, the cable diameter may be typically increased by at least 20%. The overall cost of the cable may be also substantially increased due to the possible additional cost of the center member and higher jacketing material costs.

Another disadvantage of many prior art cables is illustrated in FIG. 2. A conventional twisted pair 26 including two conductors 28*a,b* respectively centered in insulations 30*a,b* has a figure-8 shape, which has a natural groove 32. Thus, there is a tendency for multiple twisted pairs to nest together along part of the length of the cable, as one twisted pair 34 fits naturally into the groove 32 of another twisted pair 26. This tends to increase crosstalk in the nested pairs. To attempt to prevent this nesting, conventional twisted pairs may be constructed having short twist lay lengths. However, short twist lay lengths are more difficult to achieve than long twist lay lengths, and a fairly sophisticated twisting machine may be required.

SUMMARY OF THE INVENTION

In view of the foregoing, it is an object to provide an improved data cable.

One embodiment of a data cable comprises a first insulated conductor insulated by a first insulation and a second insulated conductor insulated by the first insulation. The first and second insulated conductors also include a second insulation insulating the first and second insulated conductors to comprise dual insulated conductors. The second insulation also maintains the first and second insulated conductors with respect to one another. In addition, the dual insulated first and second insulated conductors are twisted about a common central axis to form a twisted pair of conductors within the cable.

Another embodiment of a data cable comprises at least one twisted pair of conductors including a first insulated conductor surrounded along its length by a first insulation and a second insulated conductor surrounded along its length by a second insulation. The twisted pair of conductors also includes a third insulation surrounding the first insulated conductor and the second insulated conductor along their lengths to comprise dual-insulated conductors. The third insulation also fixes the first dual insulated conductor to the second dual insulated conductor along their length.

Another embodiment of a data cable comprises at least one twisted pair of conductors comprising a first insulated conductor surrounded along its length by a first insulation and a second insulated conductor surrounded along its length by a second insulation. The at least one twisted pair of conductors also includes a third insulation surrounding the first insulated conductor and surrounding the second insulated conductor along their lengths to comprise dual-insulated conductors. The first and second insulated conductors are fixed together along their lengths with a bonding agent.

BRIEF DESCRIPTION OF THE DRAWINGS

In the drawings, in which like elements are represented by like numerals.

DETAILED DESCRIPTION

Various illustrative embodiments and aspects thereof will now be described in detail. The present invention will be more easily understood after reading the following description with reference to the accompanying figures.

Figure 3:
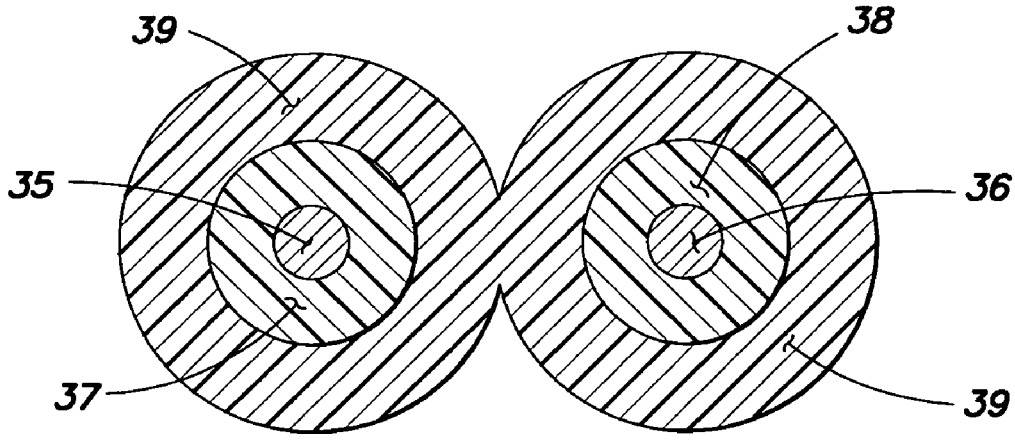
FIG. 3 illustrates a cross-sectional view one embodiment of a dual-insulated, fixed together conductors.

Referring to FIG. 3, there is illustrated one embodiment of a twisted pair of conductors that can be used, for example, in high frequency applications. The two conductors 35, 36 can be any of solid, stranded, hollow or any other configuration known to those of skill in the art. For example, the conductors may be a solid metal, a plurality of metal strands, a fiberglass conductor, a layered metal or any combination thereof. Each conductor, 35, 36 is substantially insulated along its length by a respective first insulating layer 37, 38. In one embodiment, each of the conductors 35, 36 is disposed centrally within the corresponding first insulating layer 37, 38.

Each insulated conductor 35, 36, insulated by respective first insulations 37, 38, is also insulated along their length by a second insulation 39 to comprise dual-insulated conductors along their lengths. The insulated conductors are also formed so that they are joined along their respective lengths in any suitable manner known to those of skill in the art. For example, for the embodiment illustrated in FIG. 3, the first and second insulated conductors are joined together along their respective lengths by the insulating layer 39, such that the second insulating layer fixes the first and second insulating conductors together. In other words, the second insulating layer 39 is formed, such as for example extruded, so that it joins the first and second insulated conductors.

Figure 4:
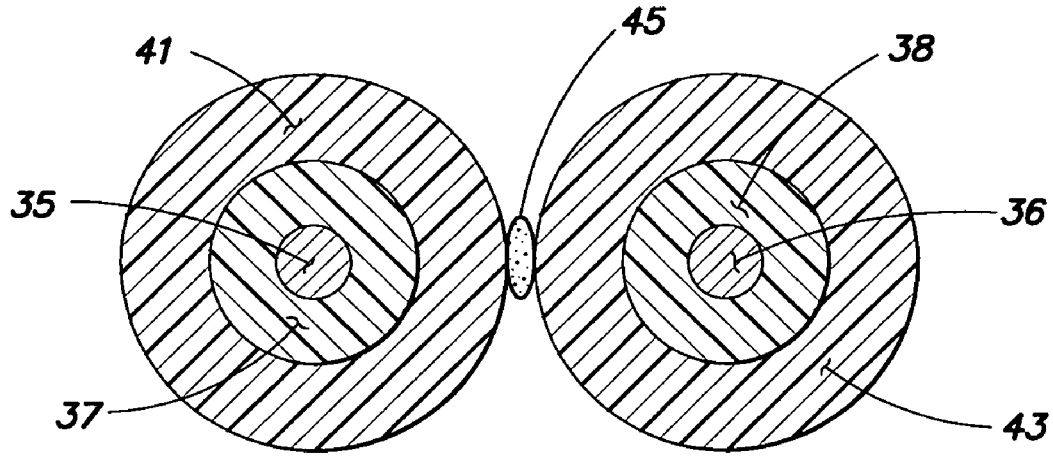
FIG. 4 illustrates a cross-sectional view of another embodiment of dual-insulated, fixed-together conductors.

FIG. 4 illustrates another embodiment of a dual-insulated, fixed together twisted pair. It is to be appreciated that like components are illustrated with like reference numbers. In this embodiment first and second insulated conductors 35, 36, insulated by respective first insulating layers 37, 38, are substantially insulated by additional second respective insulating layers 41, 43. The insulated conductors are also fixed together along their length by any appropriate bonding agent known to those of skill in the art. For example, the bonding agent may be any adhesive used in the industry. It is to be appreciated that in the embodiment of FIG. 4, the adhesive 45 is illustrated disproportionate to that which may typically be used, for purposes of illustration, and that the figure is not drawn to scale.

It is to be appreciated that the embodiments of FIG. 3 and FIG. 4 can be manufactured according to known manufacturing techniques used in the industry. For example, the insulated conductors 35, 36 are prepared by extruding insulating layers 37, 38 and 39 over the conductors 35, 36 and then adhering the insulated conductors together, for example, by causing the insulating material 39 to come together for each of the insulating conductors while the insulating material 39 is at an elevated temperature, prior to cooling, to provide a joined cable without the use of an adhesive. Alternatively, the insulated conductors 35, 36 are extruded with respective insulations 37 41 and 38 43, and brought together during the manufacturing process, for example, just after the extrusion of the insulating layers and fixed together with an adhesive or bonding agent 45 as illustrated in FIG. 4.

Accordingly, one embodiment of a method of manufacture of the twisted pairs of insulated conductors 35, 36 comprises extruding the first insulation material 37, 38 over the respective conductors, followed by extruding the second insulation material 39 over the insulated conductors 35, 36, and adhering the insulated conductors with the dual insulation layers together by contacting the first and second insulated conductors while the second insulation layer is at an elevated temperature, such that the insulated conductors affixed together when cooled. Alternatively, the method may also comprise introducing a bonding agent 45 between the dual-insulated conductors to affix the dual-insulated conductors together. The affixed insulated conductors can then be twisted at a desired twist lay to provide twisted conductors having a desired twist lay.

One embodiment of a cable comprising dual insulated conductors fixed to each other and twisted to form twisted pairs comprises high copper alloy conductors 35, 36, for example, that are 24 standard wire gauge (AWG). The first insulation layer 37, 38 insulating each conductor comprises a flame retardant polyolefin, such as polyethylene. The second insulation layer 39 insulating the insulation layers 37, 38 comprises fluorinated ethylene propylene (FEP). The first insulating layer 37, 38 and the outer insulating layer 39 of FEP may have the same or different thicknesses. The cable may also comprise a jacket (not illustrated in FIGS. 3-4), for example of minimal smoke emission such as a polyvinyl chloride or a Halar fluoropolymer. In addition, the cable may also include at least one shield that substantially surrounds the twisted pairs of conductors and that is substantially enclosed by the jacket. For example, the shield may comprise a braid such as a braid of a high copper alloy or a metallic foil such as a copper alloy layer on an insulating base layer, that can be wrapped around the twisted pairs of conductors.

It is to be appreciated that although one embodiment of a cable comprising dual insulated, fixed together twisted pairs of conductors than can makeup a core of a cable has been described, various modifications to the conductors, the insulating materials, the shielding materials and the cable materials can be made and are contemplated by this disclosure. For example, the conductors 35, 36 may be constructed of any material used in the industry, and can be, for example, solid or stranded, a copper or copper alloy, a metal coated substrate, a silver, aluminum, a steel, alloys of different materials or a combination of any of the above. In addition, the first insulating material and the second insulating materials may be any insulating materials used for the insulation of conductors, such as polyvinyl chloride, polyethylene, polypropylene, flouropolymers, flouro-copolymers, cross-linked polyethylene and the like. In addition, the diameter of each of the conductors, 35, 36, can be, for example, anywhere in the AWG range between 18 to 40 AG. Further, the insulation thickness of the first insulating layers 37, 38 can be anywhere in a range from 0.001 inches to 0.030 inches. In addition, the insulating range of the second insulating layer 39, 41, 43 can be anywhere in a range from 0.001 inches to 0.030 inches. Further, the cable core can comprise any number of twisted pairs of insulated conductors.

Some of the advantages of the cable comprising the dual-insulated, fixed-together conductors include, for example, that each twisted pair of conductors has a center-to-center distance that does not vary by more than about <0.0005 to 0.001 inches. This results from the fixing of the conductors together such that the twisting of the conductors does not result in the variations discussed above with respect to the prior art. In addition, another advantage of such embodiments of the cable of this disclosure is that the dual insulated, fixed-together, twisted pairs of conductors can be pulled apart relatively easily, for example, after an initial cut, so that the cables can be pulled apart, stripped, and terminated in any standard connector in the industry. Another advantage of the dual insulated, fixed-together, conductors is that the dual insulation layer is left intact even with the pulling apart of the insulated conductors. Still another advantage of such embodiments of such a cable is that the dual insulated conductors can be separated, for example, for at least an inch from the end of a cable to facilitate the terminating a connector, but the remainder of the cable need not separated, and can remain intact with the desired twist lay.

Figure 1:
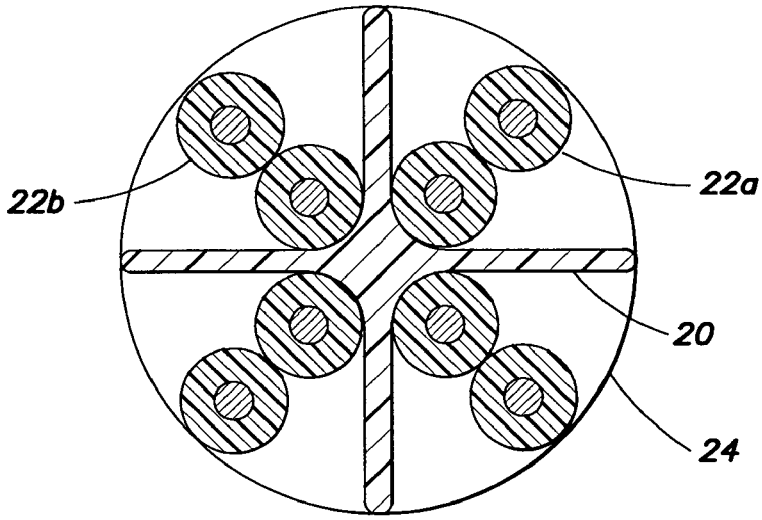
FIG. 1 (Prior Art)
FIG. 1 is a cross-sectional illustration of a prior art cable containing a central separating member.
Figure 5:
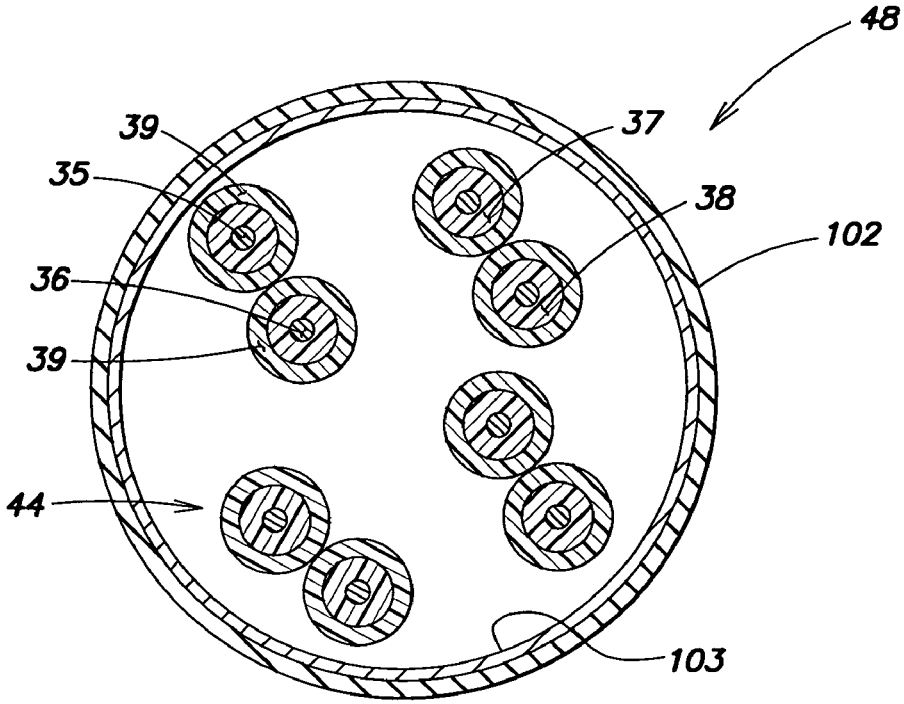
FIG. 5 is an illustration of a cross-section of one embodiment of a cable comprising a plurality of dual-insulated, fixed together twisted pairs of conductors.
Figure 6:
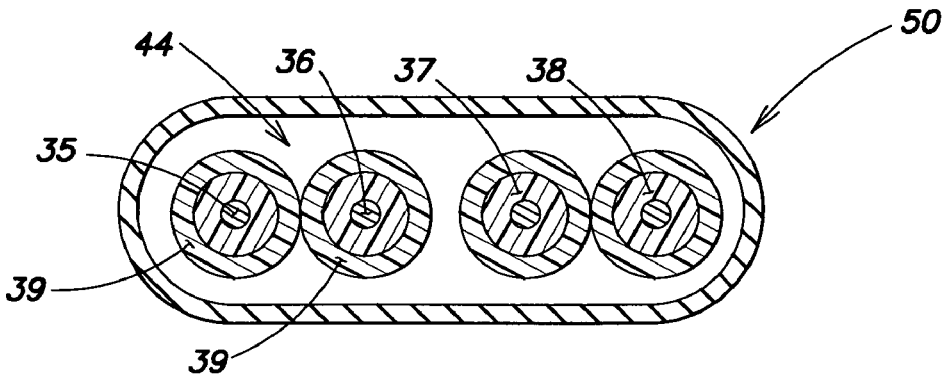
FIG. 6 is an illustration of a cross-section of another embodiment of a cable comprising dual-insulated, fixed together twisted pairs of insulated conductors.

It is to be appreciated that the cables described herein may be data, communications, or other high-performance cables and typically comprise a plurality of dual-insulated, fixed-together twisted pairs of conductors. Referring to FIG. 5, there is illustrated one embodiment of a cable comprising such dual-insulated, fixed-together insulated conductors. Each twisted pair includes two individual conductors 35, 36 that are substantially insulated by a first respective insulating layer 37, 38, and which are substantially insulated by a second insulated layer 39. The dual-insulated conductors are fixed together along their length as described above. The fixed-together, dual-insulated conductors are twisted about a common axis to form a twisted pair unit 44. The plurality of twisted pairs units are surrounded by a cable jacket 102 that may define the shape of the cable. The cable may be, for example, a substantially round cable 48, as illustrated in FIG. 5, or the twisted pairs of conductors may be disposed, for example, side-by-side in a flat cable 50, as illustrated in FIG. 6. However, it is to be understood that the invention is not limited in this regard and the cable may have any other shape used in the industry. The twisted pairs of conductors may be disposed in alternate arrangements within the cable jacket, as desired. For example a + shaped filler 20 as illustrated in FIG. 1 may be provided in the cable core.

Figure 7:
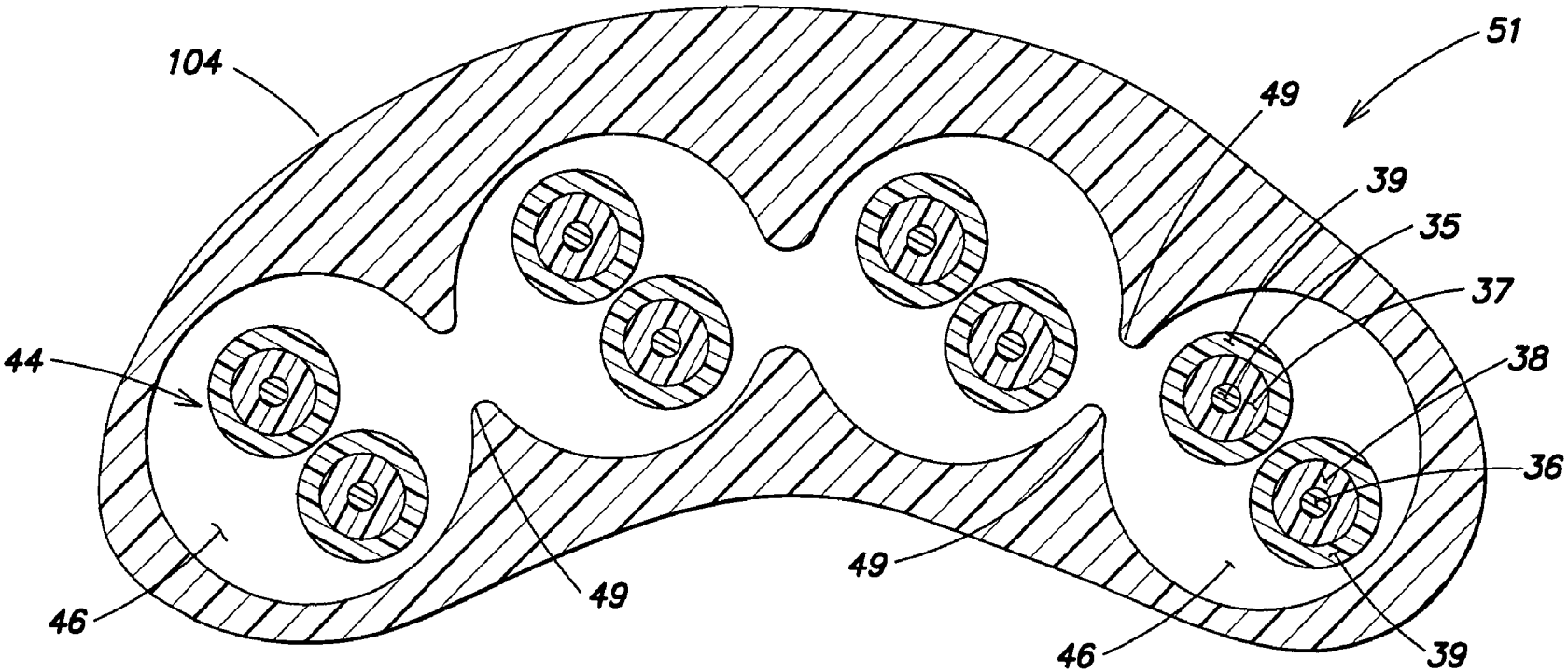
FIG. 7 is a cross-section view of yet another embodiment of a cable comprising dual-insulated, fixed together twisted pairs of insulated conductors

Referring to FIG. 7, there is illustrated another embodiment of a cable 51 comprising a plurality of dual-insulated, fixed-together twisted pairs of insulated conductors according to aspects of the invention. In this embodiment, the plurality of twisted pairs 44 may be disposed in a substantially side-by-side arrangement, as shown, each twisted pair 44 being disposed within its own channel 46 within a jacket 104 of the cable. In one example, the channels 46 may be formed by inwardly extending protrusions 49 of the jacket 104. However, it is to be appreciated that the channels 46 may also be formed by other suitable methods and structures, for example, the cable 51 may comprise a separator (not shown) that may be disposed between the twisted pairs 44 to provide the channels 46. In the illustrated example, the jacket 104 has a substantially crescent shape that defines the overall shape of the cable. However, it is to be appreciated that the jacket 104 is not limited to a crescent shape and may have various other shapes and structures as known and used in the art. For example, the cable may have a flat shape such as illustrated in FIG. 6, a round shape as shown in FIG. 5, and the like. As shown in FIG. 7, each twisted pair includes two individual conductors 35, 36 that are substantially insulated by a first respective insulating layer 37, 38, and which are substantially insulated by a second insulating layer 39. It is further to be appreciated that the second insulating layer 39 of each conductor of the twisted pair may be fixed together by any of the methods and means described herein.

Figure 8:
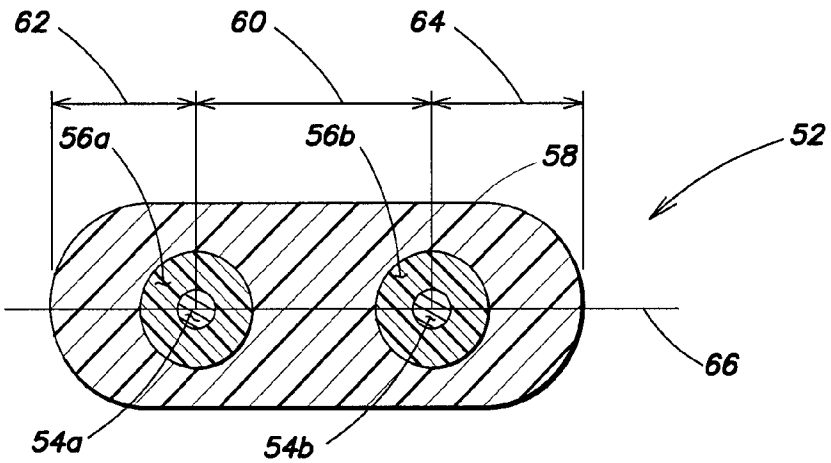
FIG. 8 is a cross-sectional view of another example of a twisted pair of conductors.

According to another embodiment of a cable, illustrated in FIG. 8, a twisted pair of insulated conductors 52 includes conductors 54*a,b*, each conductor individually insulated with a corresponding insulation 56*a,b*, to form insulated conductors. Both insulated conductors 54*a,b* are covered by a secondary insulating layer 58, to form the pair of conductors 52. The two conductors of the pair, and the surrounding insulations, are twisted about a common central axis to form the twisted pair of conductors 52. The insulation 56*a,b* surrounding conductors 54*a,b* may provide rigidity to the pair of conductors, and prevent deformation of the pair of conductors during twisting. The insulation may also control the distance between the conductors 54*a,b* and thus control the impedance of the cable. The insulation 56*a,b* is typically a solid layer to perform the functions described above, but may also be foamed in some applications.

Figure 9:
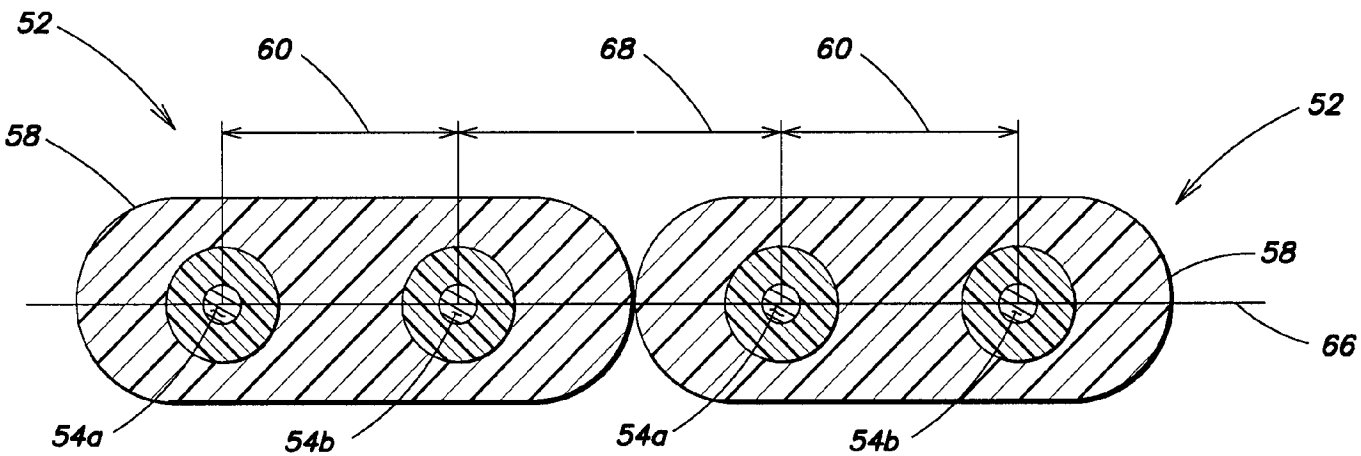
FIG. 9 is a cross-sectional illustration of two adjacent twisted pairs of conductors.
Figure 10:
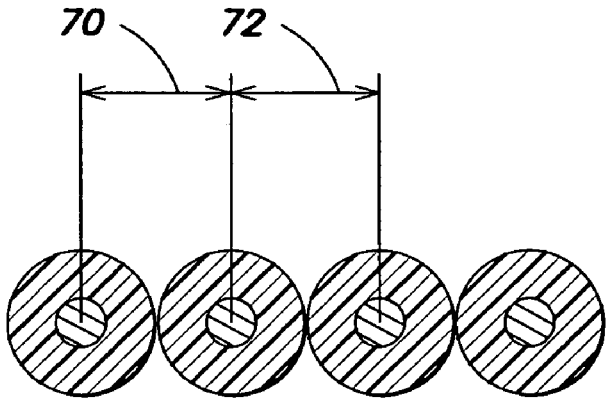
FIG. 10 (Prior Art)
FIG. 10 is an illustration of two adjacent twisted pairs according to the prior art.

According to one example, the spacing 60 between the centers of the conductors 54*a,b* is less than the sum of the distances 62, 64 from the centers of conductors 54*a,b* to the edges of the insulating layer 58, measured along a reference line 66 that passes through the centers the conductors 54*a,b*. Stated another way, the conductors 54*a,b* may be separated by a distance 60 that is smaller than the distance 68 separating conductors 54*a* and 54*b* in adjacent pairs, when cables are adjacently arranged as illustrated in FIG. 9. By contrast, in the known art, illustrated in FIG. 10, the twisted pairs of conductors are centered in tubular insulation having a circular cross-section, and the separation 70 between the two conductors in a pair is substantially equal to the separation 72 between conductors in adjacent pairs.

An advantage to a pair of conductors as illustrated in FIG. 8 is that, while the impedance of individual pairs (e.g., FIG. 5, 44; FIG. 6, 44) of the proposed cable is equivalent to that of a conventional cable having identical conductor separation, the minimum separation distance (FIG. 9, 68) between adjacent pairs of one embodiment of the proposed cable exceeds the norm in a conventional cable. The higher separation between conductors of adjacent pairs produces tangible electrical performance improvements, such as reduced crosstalk between adjacent twisted pairs and lower signal attenuation. These reductions contribute to an improved signal-to-noise performance of the proposed cable.

Figure 11:
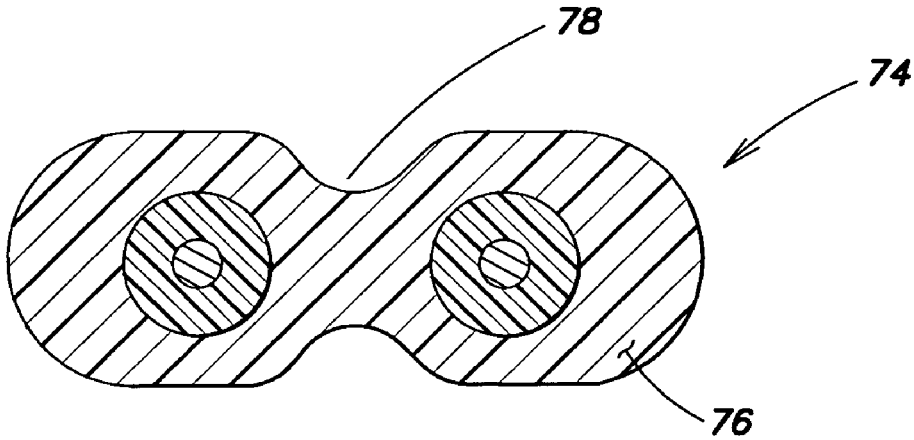
FIG. 11 is an illustration of a dual-insulated, fixed together twisted pair unit having a secondary insulating layer formed with an indentation.

In one embodiment as illustrated in FIGS. 8-9, the secondary insulation layer 58 may be uniformly formed such that the twisted pair unit has a flat oval shape. According to another embodiment, a twisted pair of conductors 74 may comprise a secondary insulation layer 76 that may be formed with an indentation 78, as illustrated in FIG. 11. In the illustrated example, the indentation is substantially centered between the two conductors, although it need not be. A cable comprising twisted pairs of conductors 74 has the same improved electrical performance characteristics as described above.

A cable comprising twisted pairs of conductors having any of the structure described above may have a number of advantages. The second insulation layer provides uniformity to the twisted pair of conductors, and facilitates twisting since there is no need to control the location and tension in two conductors. Rather, the two conductors of the pair are held in place within the pair unit by the second insulating layer, and thus only the single pair unit need be controlled. A less sophisticated twisting machine may therefore be used to perform the twisting, which may reduce the cost of the cable. A cable containing these twisted pairs may also be easier to terminate than a cable containing conventional twisted pairs. One reason for this is that the secondary insulating layer holds each conductor of the twisted pair in a known location relative to the other conductor and to the twisted pair unit. Therefore, there is no need to locate and/or control the tension or twist in two conductors, as is the case for conventional twisted pairs.

One mechanical characteristic of elastomers is their capacity to undergo relatively high strain in the elastic domain under relatively low mechanical stress and to achieve complete recovery following the release of the stress. Conversely, for high elastic modulus materials, there is typically a small strain domain where the material behaves elastically under relatively high stress; beyond that domain, high modulus materials may deform permanently or plastically.

According to one embodiment, the cable described herein takes advantage of the presence of an elastomer as the secondary insulating layer to create, during the twisting process and pair unit assembly, a structure that may be mechanically pre-stressed and may resist further deformations. For example, the elastomer layer may be readily deformed to effect a deformation that may be still in the elastic domain following the twisting process, and may resist further deformations. The elastomer layer may also cushion variations in the tension generated in the pair unit during spooling, which may result in better spooling and may facilitate twisting of the pair unit. The elastomer layer may also absorb variations in tension generated during twisting, thereby limiting dimensional variations to the thickness of the elastomer layer, which may help to stabilize the impedance of the cable.

Figure 2:
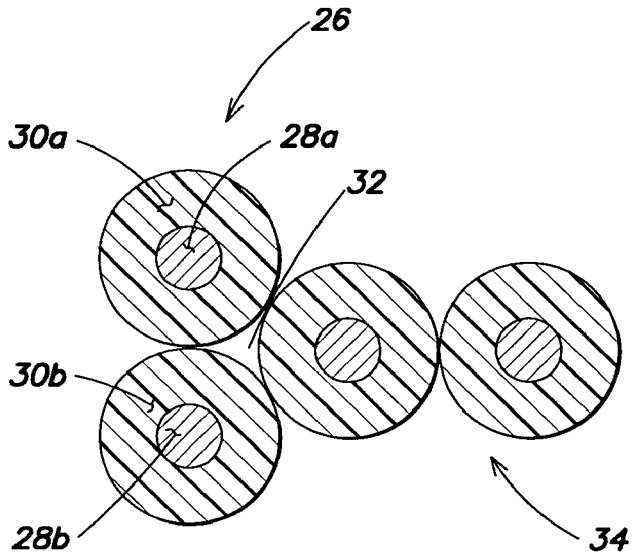
FIG. 2 (Prior Art)
FIG. 2 is an illustration of nesting among twisted pairs according to the prior art.

Yet another advantage of a cable comprising some embodiments of the twisted pair units described above is that the flat oval shape of the twisted pair unit resists nesting, thereby helping to reduce crosstalk between twisted pair units in the cable. As discussed above, conventional twisted pairs typically have a figure-of-8 shape that has a wide natural groove that tends to cause nesting of the multiple twisted pairs in a cable (see FIG. 2). By comparison, the flat, oval shape of the twisted pair unit (FIG. 8, 52) described above resists nesting as the secondary insulating layer may be formed without a groove. The fact that the twisted pair units resist nesting also allows the twisted pair units to have a longer twist lay length which may be beneficial in terms of cost, and may allow a less sophisticated twisting machine to be used to perform the twisting.

As discussed above, the oval shape and eccentricity of the twisted pair units of the proposed cable described above reduces crosstalk between twisted pairs within the cable. Therefore, the proposed cable may have acceptably low levels of crosstalk without using a central separator. This is advantageous since, as discussed above, a central separator may increase the size, cost, and manufacturing complexity of a cable, and may cause increased alien crosstalk. Furthermore, for cables having an equal jacket thickness and tightness, the twisted pair units of the proposed design may be located closer to the center of the cable than they would be were a central separator used, meaning that they are inherently further away from twisted pairs in an adjacent cable. This may tend to reduce alien crosstalk between stacked cables, compared with conventional cables having a central separator. Alternatively, the outer diameter of the proposed cable may be reduced compared with a conventional cable having a central separator, since the twisted pairs may be more closely spaced within the cable. This may be advantageous in terms of cost and space required for installation of the cable.

According to another embodiment, the outer insulating layer may be used as a carrier for color, flame retardant or smoke retardant additives. This may be particularly advantageous for cables that are desired to be used in fire retardant applications. The insulating layer may incorporate inorganic flame retardant particles, or may be itself a flame retardant polymer. In yet another example, the outer layer of insulation may be foamed in order to reduce the signal attenuation of a twisted pair unit, and thus of a cable comprising such twisted pair units, since foaming may lower the dielectric constant of the layer by increasing the amount of air present in the layer. Foaming may also increase the compressibility of the outer insulation layer.

According to one embodiment, the cable comprising the dual-insulated, fixed together twisted pair may be an unshielded cable, as is illustrated in FIG. 5. In this example, the cable includes a plurality of twisted pair units 44, typically four, wrapped in a cable jacket 102 with no shielding around either the pair units themselves, or the cable as a whole. It is to be appreciated that while the illustrated cable has four twisted pairs in an exemplary configuration, the proposed cable is not so limited. Furthermore, the twisted pair units may have any secondary insulating layer as described herein.

In another embodiment, the cable may be a shielded cable, as is also illustrated in FIG. 5. A shielded cable can include a single shield or screen 103, that surrounds all of a plurality of twisted pair units 104, underneath the cable jacket 102. Typical prior art shielded cables may need larger insulated conductors in order to ensure that the shield is further away from the center wire of the conductors, so as to prevent the shield from interfering with the conductors, causing crosstalk. A shielded cable may be made from any of the twisted pairs units described above. An additional advantage of constructing a shielded cable using any of the twisted pair units as disclosed herein is that the twisted pair units may be inherently more rigid that conventional twisted pairs, and thus may tend to maintain their shape and facilitate the shield 103 being wrapped around them. The shield may be conductive, such as a conductive braid or a metallic foil, and may be supported by a polymer film. A drain wire may also be included in the cable jacket and may be connected to the shield.

According to yet another embodiment, the cable may be a fully shielded cable wherein each twisted pair unit 44 is also individually shielded with a shield (not illustrated), and an overall shield 103 is additionally applied underneath the cable jacket 102, and surrounding all of the plurality of twisted pair units. Fully shielded cables may be standard for CAT7 cables. Either or both of the individual shields and the additional overall shield may be conductive, and may be, for example, a conductive braid or metallic foil. The shields may be supported by polymer films.

Having thus described various embodiments of proposed cables, and aspects thereof, modifications and variations may be apparent to those of ordinary skill in the art. For example, it is to be appreciated that while exemplary embodiments of various shielded and unshielded cables have been illustrated to have the dual-insulated, fixed together twisted pair units arranged in a particular configuration, the proposed cables are not so limited. The cables may include any number of such twisted pair units that may be arranged in any configuration within the cable jacket. Additionally, such twisted pair units may have any described secondary insulating layer. Furthermore, the cables need not be round and may be flat or have another outer shape as desired. The cables may also include a central separating member to separate individual twisted pair units from one another. Such and other modifications and variations are intended to be covered by this disclosure, and the scope of the invention is determined by proper construction of the appended claims, and their equivalents.

What is claimed is:

1. A data cable comprising:

at least one twisted pair unit including a first insulated conductor surrounded along its length by a first insulating layer and a second insulated conductor surrounded along its length by a second insulating layer; and a jacket surrounding the at least one twisted pair;

wherein the at least one twisted pair further comprises a third insulating layer surrounding the first insulated conductor and the second insulated conductor along their lengths to comprise first and second dual-insulated conductors, the third insulation also fixing the first first insulated conductor to the second dual insulated conductor along their length;

wherein a distance between a center of the first insulated conductor and a center of the second insulated conductor is less than a sum of a distance from the center of the first insulated conductor to a proximate edge of the third insulating layer and a distance from the center of the second insulated conductor to an opposing edge of the third insulating layer, measured along a reference line that passes through the centers of the first and second insulating conductors wherein the third insulating layer is formed such that the twisted pair has a flat oval shape; and wherein the first and second insulated conductors and the third insulating layer are twisted about a common central axis to form the at least one twisted pair.

2. The data cable as claimed in claim 1, wherein the first insulating layer comprises a polyolefin.

3. The data cable as claimed in claim 1, wherein the third insulating layer comprises a fluoropolymer or fluoro-copolymer material.

4. The data cable as claimed in claim 1, further comprising a shield substantially surrounding the dual-insulated pair of conductors.

5. The data cable as claimed in claim 4, wherein the shield comprises a metallic foil.

6. The data cable as claimed in claim 5, wherein the metallic foil comprises a polymer layer.

7. The data cable as claimed in claim 4, wherein the shield comprises a conductive braid.

8. The data cable as claimed in claim 1, wherein the third insulating layer is an extruded polymer.

9. The data cable as claimed in claim 8, wherein the extruded polymer comprises flame retardant particles.

10. A data cable comprising;

a twisted pair of dual-insulated conductors comprising:

a first insulated conductor insulated by a first insulation comprising an insulating material;

a second insulated conductor insulated by a second insulation comprising the insulating material;

a third insulation insulating the first and second insulated conductors to comprise first and second dual-insulated conductors, the third insulation comprising:

a first portion substantially surrounding the first insulated conductor;

a second portion substantially surrounding the second insulated conductor;

a third portion joining the first and second portions; and a jacket surrounding the twisted pair;

wherein the first and second dual insulated conductors are twisted about a common central axis to form the twisted pair;

wherein the third insulation maintains the first and second insulated conductors with respect to one another and is formed such that the twisted pair has a flat oval shape; and wherein a distance between a center of the first insulated conductor and a center of the second insulated conductor is less than a sum of a distance from the center of the first insulated conductor to a proximate edge of the second insulating layer and a distance from the center of the second insulated conductor to an opposing edge of the third insulating layer, measured along a reference line that passes through the centers of the first and second insulating conductors.

11. A data cable comprising:

at least one twisted pair of conductors comprising a first insulated conductor surrounded along its length by a first insulation and a second insulated conductor surrounded along its length by a second insulation; and a jacket surrounding the at least one twisted pair of insulated conductors;

wherein the at least one twisted pair of conductors further comprises a third insulation surrounding the first insulated conductor and surrounding the second insulated conductor along their lengths to comprise first and second dual-insulated conductors, the third insulation being constructed to maintain the first and second dual-insulated conductors with respect to one another;

wherein the first and second dual-insulated conductors are twisted about a common central axis to form the at least one twisted pair;

wherein the third insulation is formed such that the twisted pair has a flat oval shape; and wherein a distance between a center of the first insulated conductor and a center of the second insulated conductor is less than a sum of a distance from the center of the first insulated conductor to a proximate edge of the third insulation and a distance from the center of the second insulated conductor to an opposing edge of the third insulation, measured along a reference line that passes through the centers of the first and second insulated conductors.

* * * * *